United States Patent [19]

Bujan

[11] 4,132,135

[45] Jan. 2, 1979

[54] OPENING DEVICE FOR TEAR OPEN PORT OF A CONTAINER

[75] Inventor: Albert F. Bujan, Waukegan, Ill.

[73] Assignee: Abbott Laboratories, North Chicago, Ill.

[21] Appl. No.: 842,445

[22] Filed: Oct. 14, 1977

Related U.S. Application Data

[63] Continuation of Ser. No. 709,760, Jul. 29, 1976, abandoned.

[51] Int. Cl.[2] ..... B67B 7/00

[52] U.S. Cl. ..... 81/3.46 A

[58] Field of Search ..... 29/267, 278; 81/3.46 R, 81/3.46 A

[56] References Cited

U.S. PATENT DOCUMENTS

| | | | |
|---|---|---|---|
| 1,215,019 | 2/1917 | Hansen | 81/3.46 A |
| 2,609,715 | 9/1952 | Eades | 81/3.46 A |
| 3,713,200 | 1/1973 | Burns | 81/3.46 R X |
| 3,736,643 | 6/1973 | Pepe | 81/3.46 R X |

*Primary Examiner*—Al Lawrence Smith
*Assistant Examiner*—James G. Smith
*Attorney, Agent, or Firm*—Robert L. Niblack; Neil E. Hamilton

[57] ABSTRACT

An opening device for use in tearing open the closure or port of a container. A bar-like member has a pivotal portion for engagement on the top of a container and a slot for receiving a tab-like portion with the tab portion having an enlargement which will engage on the bar-like member. When the bar-like member is grasped by a handle and a force exerted away from the container by movement of the arcuate portion on the container port the tab will effect a tearing away from the port and expose the contents of the container. The opener is preferably designed for use in conjunction with opening a parenteral or I.V. solution container which is composed of a flexible plastic material.

15 Claims, 7 Drawing Figures

OPENING DEVICE FOR TEAR OPEN PORT OF A CONTAINER

This is a continuation of application Ser. No. 709,760 filed July 29, 1976 now abandoned.

CROSS REFERENCE TO RELATED APPLICATIONS (None)

BACKGROUND OF THE INVENTION

This invention relates to an opening device for engaging a tear-open-type strip for opening a container. More particularly, the invention relates to a slotted-type opener which will engage a tabular portion with an enlargement section and having an arcuate rocking portion to engage the upper surface of the container port so that upon movement of the opener away from the port a tearing of the tab from the container port will be effected in the area adjacent the port and thereby open it.

The opening device of this invention is specially adapted for use in conjunction with opening sterile solution containers of the flexible bag variety such as described in U.S. Pat. No. 3,915,212. This particular patent discloses a fill and administration port as well as an additive port which is sealed by a cover with a handle extending therefrom to tear the cover from the port. In some instances, a nurse finds on multiple openings that her fingers fatigue and/or may not have the strength to pull the tab so as to effect the necessary tear opening of the port. It then becomes necessary to find a tool such as a pliers in order to grip the flange and tear it from the port. This could result in contamination in the area surrounding the port if care is not taken. Further, the use of an implement such as a pliers still may not concentrate the tearing forces in the required area so as to expedite the removal of the cover on the port.

It is an advantage of the present invention to provide an opening device for a container having a tear away cover portion wherein the tear-open cover is removed with a minimum amount of force. Other advantages are an opener which can obviate any risk of contaminating the opened area and which is inexpensive.

SUMMARY OF THE INVENTION

The foregoing advantages are accomplished by the present opening device which has a body member defining a handle portion and a spaced projecting arcuate portion extending from one side thereof. An opening is disposed in the body member defining a slot with adjacent support surfaces for receiving a tab portion forming a covering on a container port. The tab portion has an enlarged engagement section which will contact the support surfaces on the body member with the tab disposed in the opening. With placement of the arcuate portion on a flat wall portion of the cover and with a rotary force exerted on the handle in a direction opposite the container, a pulling force is effected on the tab portion and a tearing of the cover and the flat wall portion from the port. In a preferred embodiment, the opening is defined inside the body of the opening device with the opening being in the form of an elongated slot. The lateral walls of the slot are preferably formed by ledges with rounded surfaces and the projecting portion is coextensive with the end of the body member, with one lateral support ledge being coextensive with the arcuate portion.

BRIEF DESCRIPTION OF THE DRAWINGS

A better understanding of the present opening device will be accomplished by reference to the drawing wherein.

DESCRIPTION OF ONE EMBODIMENT

Figure 1:
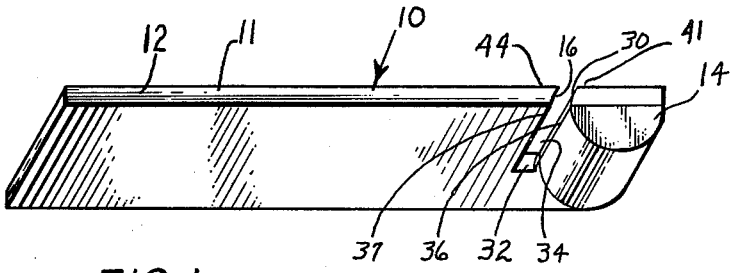
FIG. 1 is a perspective view of the opening device as viewed from the bottom thereof.

Proceeding to a detailed description of one embodiment of the present invention, an opening device generally 10 is shown for use in conjunction with a flexible parenteral container 20 having a container port 22 and sealed with a flat wall 24 of cover 23 over the port with a tab 26 extending therefrom.

As best shown in FIG. 1, opening device 10 has a bar-like body member 11 forming a handle portion 12 at one end and a projecting arcuate portion 14 at the other. Between these two portions is a slot-like opening 16 having an entrance passage 30 and an opposite end wall 32. It will be noted that the elongated slot 16 is formed from two lateral walls 36 and 37 with wall 36 being a common wall for the arcuate portion 14 and consequently, being rounded or arcuate in configuration and in effect, is concentrically positioned with respect to wall 36.

It will be further noted that arcuate portion 14 is coextensive with the end wall 38 of the body member and is substantially semicircular in configuration.

OPERATION

A better understanding of the advantages of the opening device 10 will be had by a description of its operation. As indicated earlier, a tear-open port of the type to be used in conjunction with the opener 10 is shown by the numeral 22 and is closed by a cover 23 which can be removed from the port. The cover 23 is in effect formed from a flat wall portion 24 and a front wall section 25 which is tapered to a point 27.

Figure 4:
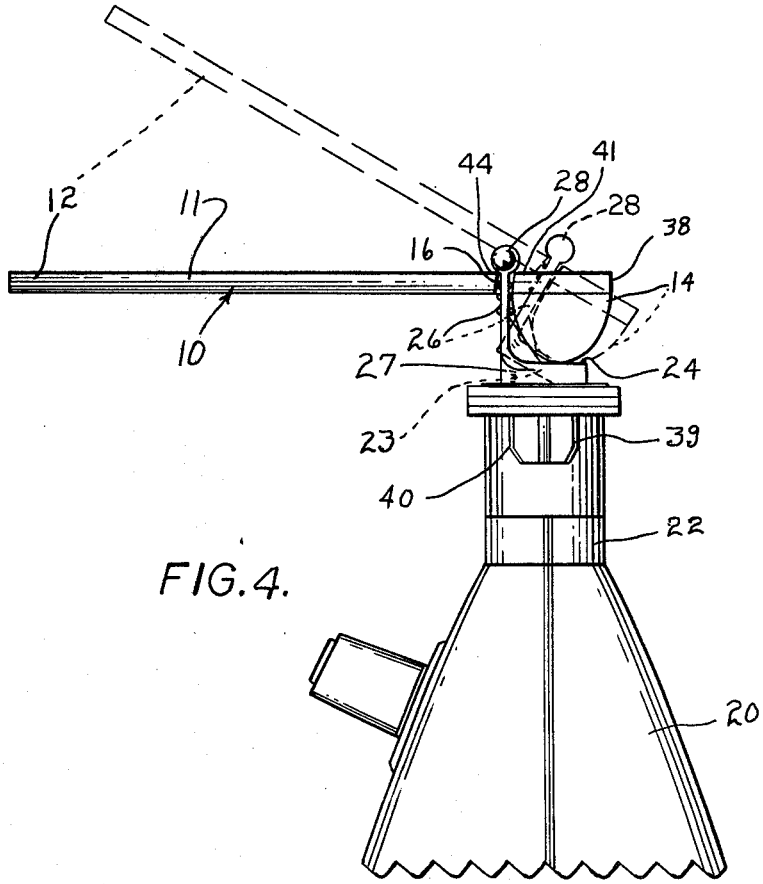
FIG. 4 is a view in side elevation showing the opening unit as engaging the tabular portion of the opening port and also in a position showing the tearing action of the cover wall, as indicated in broken lines.
Figure 2:
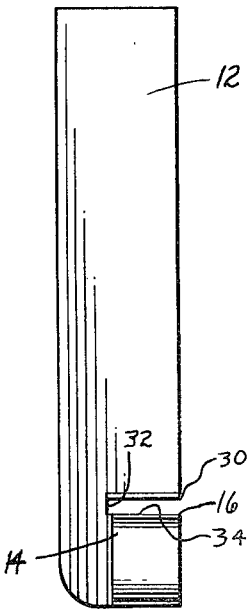
FIG. 2 is a top plan view of the opening device shown in FIG. 1.

When it is desired to open container port 22, the opener 10 will be positioned as shown in the solid lines in FIG. 4. In this position, arcuate portion 14 will rest on the top of flat wall 24 and tab 26 will be inserted in opening 16 by means of entrance passage 16 with enlargement 28 seated against upper wall surface of opener body 11. In this position, the adjacent upper wall surfaces 41 and 44 will act as a support so all that is required to open port 22 is to effect rotary movement of handle 12 upwardly and in a direction away from container 22 to initially effect a tearing at point 27 of the front wall 25 of cover 23. With continued upward movement the tearing will continue in opposite directions around the top of cover 23 until it and the flat wall portion 24 are completely removed. An advantage of having arcuate portion 14 is that it not only effects a stabilized resting point during the rotation of the opener, but it also will effect additional pulling by providing a continuous contact surface for tab 26 as it is bent around the arcuate surface during the previously described motion of the opener. Also facilitating a pulling effect on tab 26 without severing or cutting is the fact that lateral wall surfaces 36 and 37 are arcuate in configuration to better accommodate the tab during the rotary motion of the opener.

DESCRIPTION OF ANOTHER EMBODIMENT

Figure 5:
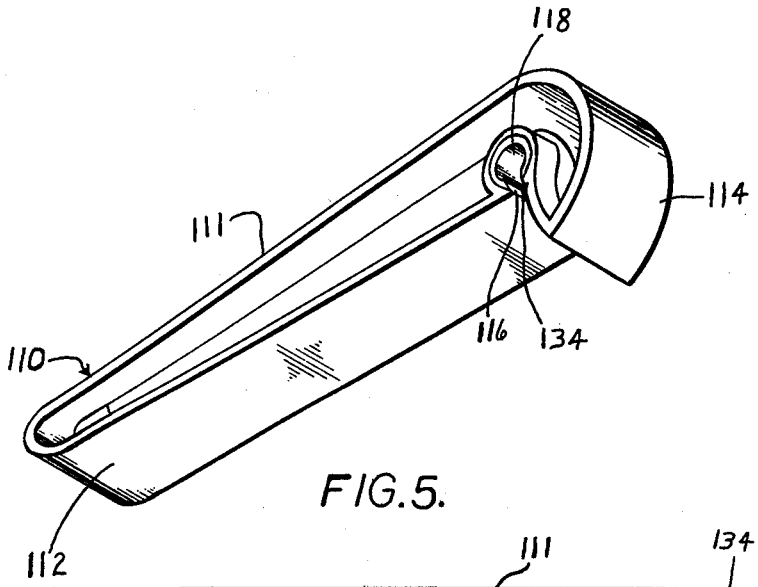
FIG. 5 is a perspective view of another embodiment of the present invention.
Figure 6:
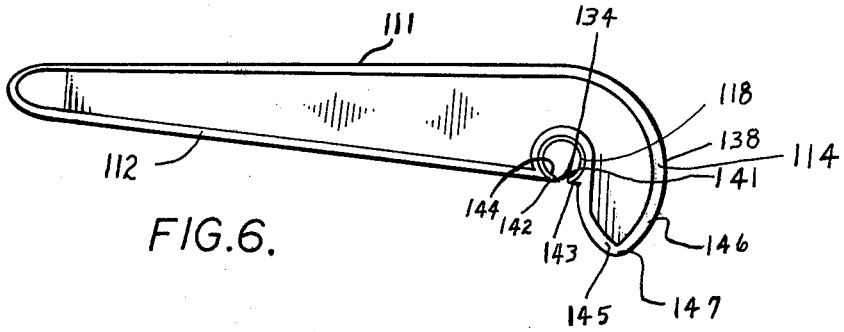
FIG. 6 is a view in side elevation of the embodiment of in FIG. 5.
Figure 7:
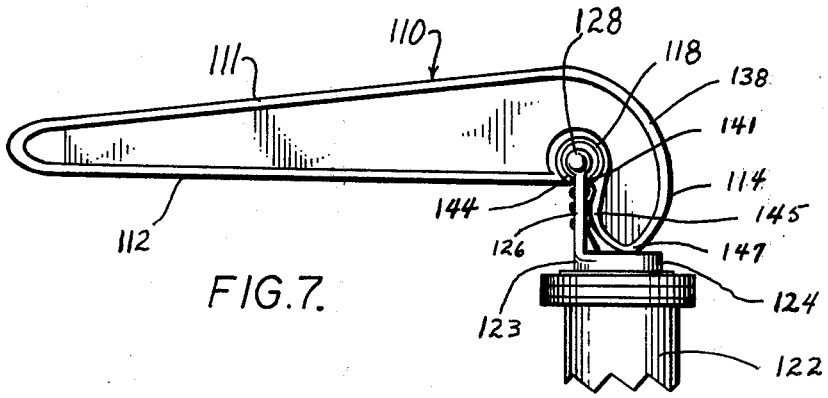
FIG. 7 is a view similar to FIG. 6 showing the engagement of the opening device of this invention with a tear-open closure as in FIG. 4.

In FIGS. 5 – 7 an opening device 110 is disclosed which is similar in its function to device 10. Accordingly, similar numbers are indicated for similar parts except they are numbered in the "100" series. Opener 110 has a body member 111 with a handle portion 112 and an arcuate portion 114. One of the basic differences between unit 10 and 110 is in the location of opening 116. In unit 110 it is located within the confines of and surrounded by the body member 111 with elongated slot 134 extending from the exterior of the handle 112 and projecting portion 114. Slot 134 is in effect formed as a portion of enlarged opening 118 to thereby provide opposing adjacent support surfaces 141 and 144 on ledges 142 and 143 for enlargement 128 on tab 126. It will also be noted that in opener 110 the arcuate projecting portion 114 is formed from two distinct arcuate sections 145 and 146 with an intermediate extending point 147.

OPERATION

The operation of opening device 110 is the same as for unit 10. It will be noted that with opener 110 the same advantage of continuous pulling and guidance is provided by arcuate section 145 during the tearing of tab 126 of cover 123.

Figure 3:
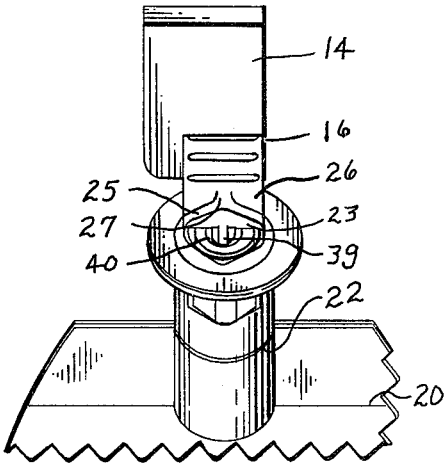
FIG. 3 is a partial view of a container and an end view of the opening device engaging a tab portion on the port of the container.

As illustrated specifically in FIGS. 3 and 7 and although only forming one type of closure which is operable with the openers of this invention, is an inner plug member 39 secured to covers 23 and 123 which seats in an inner tubular member 40 in container port 22 and 122. The purpose of the plug 39 is to stabilize the covers 23 and 123.

While openers 10 and 110 have been described in conjunction with a specific type of tear-open covers 23 and 123 for a parenteral solution container 20, it will be readily recognized that any type of tear open cover could be utilized which has a tab with an enlargement for retention in slots 34 and 134 and a bearing surface for pivotal portions 14 and 146. Further, while the lateral walls of slot 16 are arcuate in configuration, this is not a necessary requirement nor is the fact that one of the slot walls is in effect a continuation of arcuate portion 14. If necessary the slot could be spaced from the arcuate portion. Neither is it essential that the arcuate portions be coextensive with the end walls 38 and 138. If desired, the end wall could be projected beyond the arcuate portion although it would interfere with the rotary motion at that point where the body member would contact the cover to assume a perpendicular position to the top of the cover.

In a preferred manner opening device 10 is fabricated from aluminum and device 110 from a rigid plastic material. However, other metallic or various rigid plastic materials could be employed. While the fabrication of covers 23 and 123 as well as the container 12 is composed of a flexible plastic material, the opener could also be employed with other flexible materials such as thin tabular portions of aluminum and steel. Further, and as indicated in unit 110, arcuate portion 14 can be integrally molded with body member 11 or formed separately and attached by means of screws or welding.

It will thus be seen that through the present invention there is now provided an opening device which can engage a tabular portion of a covering on a container and remove it in a fast and efficient manner. The opener is simple in design and construction; it can open the port of a container such as one for sterile solutions without undesired contact of the port during or after cover removal. The opener is inexpensive to manufacture and obviates the requirement of having sharpened projections or points.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. An opening device for a tear-open port of a container wherein the port is defined by a cover having a substantially flat wall portion in a sealed but tear-open manner and a tab portion extending from said flat wall portion and having an enlarged engagement section spaced from said flat wall portion comprising:

a body member defining a handle portion and a spaced, projecting portion extending from one side thereof;

an opening in said body member defined by at least two spaced wall surfaces, said wall surfaces extending into said body member from one side thereof and extending in a first direction;

support surfaces defined by said body member and being continuous with said wall surfaces, said support surfaces spaced from said one side of said body member and extending away from said wall surfaces in opposing directions from said first direction, said opening adapted to receive said tab portion with said enlarged section positioned in contact with said support surfaces of said body member so that upon placement of said projecting portion on said flat wall portion and said tab portion in said opening with said enlarged engagement section containing said support surfaces of said body member, a force exerted on said handle portion and in a direction opposite to said projecting portion will effect a rotary pulling force on said tab portion by means of said projecting portion and the tearing of said flat wall portion from said port.

2. The opening device as defined in claim 1 wherein said projecting portion is arcuate in configuration.

3. The opening device as defined in claim 2 wherein said opening is defined by an entrance passage at one end and an opposing end wall at the opposite end.

4. The opening device as defined in claim 3 wherein said opening is defined by an elongated slot.

5. The opening device as defined in claim 4 wherein both lateral walls of said slot are arcuate in configuration.

6. The opening device as defined in claim 5 wherein one arcuate all is coextensive with said projecting portion.

7. The opening device as defined in claim 6 wherein said arcuate wall is semicircular in 8. The opening device as defined in claim 7 wherein said body member is substantially flat.

9. The opening device as defined in claim 2 wherein said projecting portion is defined by two distinct arcuate sections separated by an intermediate extending point.

10. The opening device as defined in claim 1 wherein said opening in said body member define a slot with said support surfaces, and said opening surrounded by said handle portion and said projecting portion except for said slot.

11. The opening device as defined in claim 10 wherein one os said support surfaces is formed from a ledge extending inwardly from said projecting portion and is positioned in said body member where said projecting portion merges with said handle portion.

12. The opening device as defined in claim 11 wherein said support surfaces comprise an opposing ledge surface.

13. The opening device as defined in claim 12 wherein said ledge surfaces are formed from an enlarged circular opening in said body member with said slot extending from the exterior of said handle and projecting portions and into said opening.

14. An opening device for a flexible, plastic tear-open port of a flexible, plastic container wherein the port is defined by a cover having a substantially flat wall portion in a sealed but tear-open manner and a flexible, plastic, substantially flat tab portion extending from said flat wall portion and having an enlarged engagement section spaced from said flat wall portion comprising:

a body member defining a handle portion and a spaced, projecting portion having a major axis extending from one side thereof;

an opening within the confines of said body member defined by at least two spaced wall surfaces, said wall surfaces extending into said body member from said one side thereof and extending in a first direction substantially parallel with said axis of said projecting portion;

support surfaces continuous with said wall surfaces, extending in opposing directions from said direction outwardly from said wall surfaces, said opening adapted to receive said tab portion with said enlarged section positioned in contact with said support surfaces of said body member so that upon placement of said projecting portion on said flat wall portion and said tab portion in said opening with said enlarged engagement section contacting said support surfaces of said body member, a force exerted on said handle portion and in a direction opposite to said projecting portion will effect a rotary pulling force on said tab portion by means of said projecting portion and the tearing of said flat wall portion from said port.

15. The opening device as defined in claim 14 wherein said opening is substantially circular in configuration and said opening and said support surfaces are surrounded by said body member.

* * * * *

UNITED STATES PATENT OFFICE

CERTIFICATE OF CORRECTION

PATENT NO. : 4,132,135

DATED : January 2, 1979

INVENTOR(S) : Albert F. Bujan

It is certified that error appears in the above-identified patent and that said Letters Patent are hereby corrected as shown below:

In Column 2, line 22, delete "of" and insert --shown--.

In Column 5, Claim 6, line 2, delete "all" and insert --wall--.

In Column 5, Claim 7, line 5, after "in" add --configuration--.

In Column 5, Claim 11, line 18, delete "os" and insert --of--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*